US006105629A

United States Patent [19]

Bourgeaux et al.

[11] Patent Number: 6,105,629

[45] Date of Patent: Aug. 22, 2000

[54] HOUSING FOR ELECTRIC SHEDDING ACTUATORS

[76] Inventors: Pierre Bourgeaux, 77 route de la Montagne Lachat, Poisy, France, 74330; Jean-Paul Froment, 142 route des Cotes, Doussard, France, 74210

[21] Appl. No.: 09/217,805

[22] Filed: Dec. 22, 1998

[30] Foreign Application Priority Data

Dec. 24, 1997 [FR] France ..... 97 16735

[51] Int. Cl.[7] ..... D03C 3/20; D03C 3/16; D03C 5/00

[52] U.S. Cl. ..... 139/455; 335/219

[58] Field of Search ..... D06/396; 335/135, 335/133, 219, 202; 139/455, 66 R; 119/23

[56] References Cited

U.S. PATENT DOCUMENTS

| | | | |
|---|---|---|---|
| 1,958,640 | 5/1934 | Reynolds | 335/133 |
| 2,312,902 | 3/1943 | Hickman et al. | 335/133 |
| 3,792,685 | 2/1974 | Wiener | 119/23 |
| 3,804,066 | 4/1974 | Lowe | 119/23 |
| 4,609,897 | 9/1986 | DeKoster et al. | 335/133 |
| 5,125,435 | 6/1992 | Froment | 139/455 |
| 5,462,097 | 10/1995 | Skalka . | |
| 5,717,370 | 2/1998 | Haas | 335/132 |
| 5,769,244 | 6/1998 | Wyatt | 211/40 |
| 5,862,922 | 1/1999 | Gallagher | 211/41.12 |

FOREIGN PATENT DOCUMENTS

| | | |
|---|---|---|
| 0304985 | 3/1989 | European Pat. Off. . |
| 0353005 | 1/1990 | European Pat. Off. . |
| 0668381 | 8/1995 | European Pat. Off. . |
| 2736659 | 1/1997 | European Pat. Off. . |
| WO8102312 | 8/1981 | WIPO . |
| WO9703237 | 1/1997 | WIPO . |

*Primary Examiner*—Andy Falik
*Attorney, Agent, or Firm*—Dowell & Dowell, P.C.

[57] ABSTRACT

A housing for the removable positioning of one or more rotary electric actuators used for formation of the shed of a weaving loom and which housing includes at least one compartment which allows the actuators to be received and removed therefrom by movement in a direction parallel to an axis of rotation of rotary elements associated with the actuators and which elements control the movement of the harness cords of the shed forming device. The housing allows harness threads to be moved relative thereto with respect to the rotary elements and may include a cover to encase the rotary elements associated with the actuators.

18 Claims, 5 Drawing Sheets

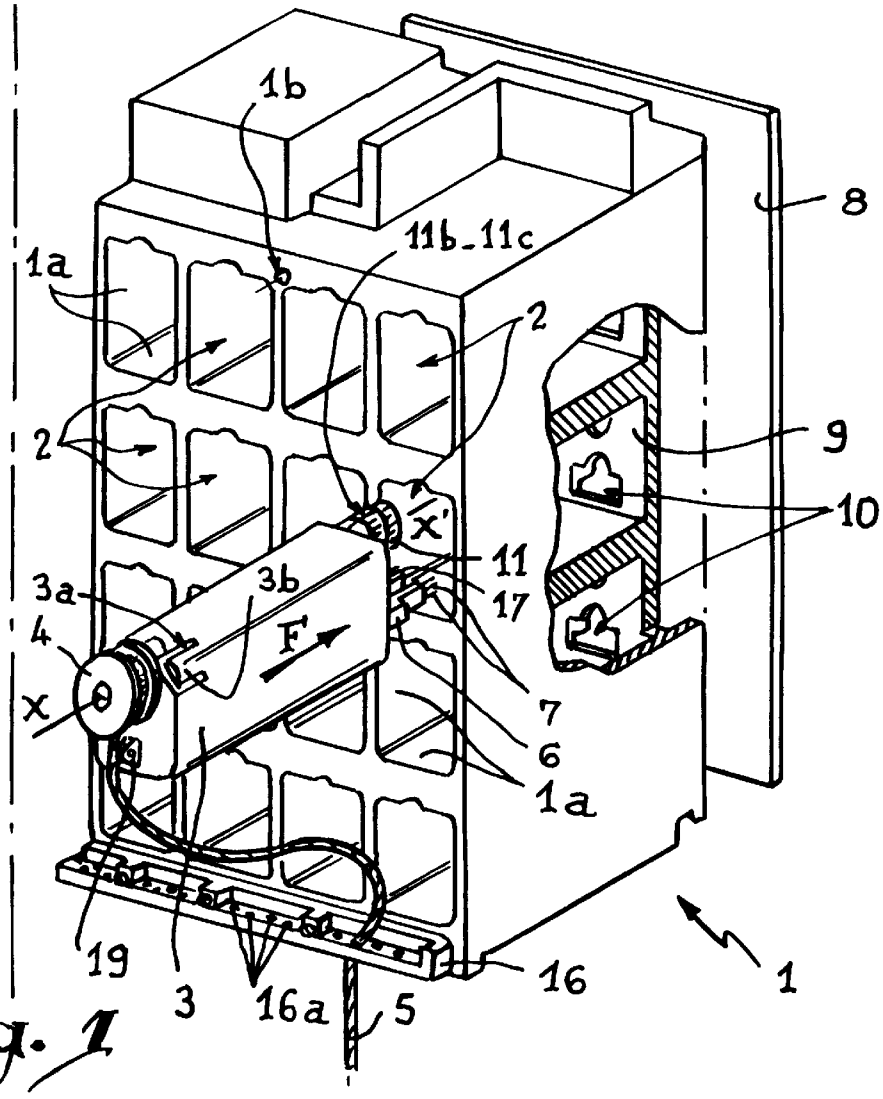
Fig. 1
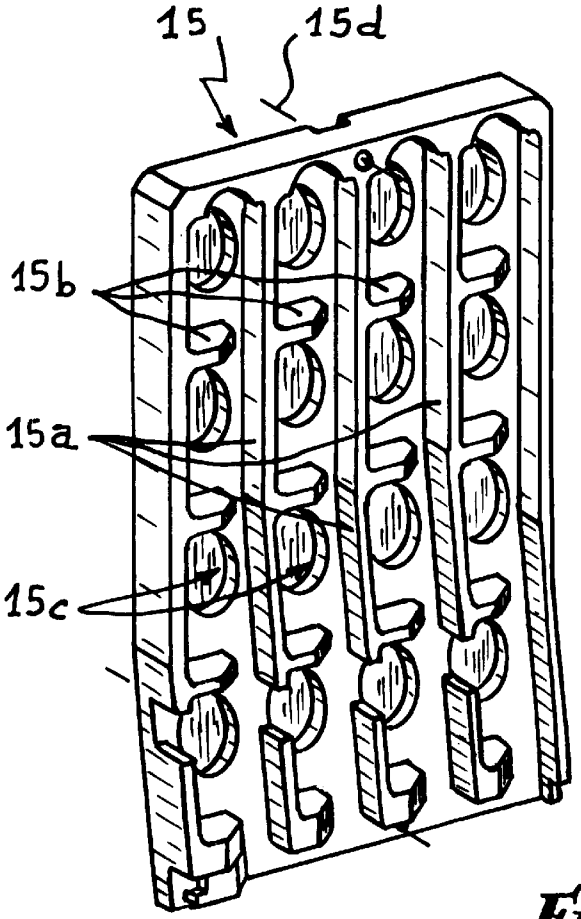

HOUSING FOR ELECTRIC SHEDDING ACTUATORS

BACKGROUND OF THE INVENTION

1. Field of the Invention

The present invention relates to a housing for the positioning of electric actuators for the formation of the shed on a loom, and particularly for the control of the harness threads of a Jacquard-type weaving mechanism, and to a loom.

2. Description of the Related Art

It is known to use a rotary motor, such as a stepping motor or a servomotor to linearly control a twine pertaining to a loom.

Taking into account the large number of harness threads that may comprise a Jacquard-type weaving mechanism, the actuators associated with these harness threads must be arranged with respect to each other in such a manner that they can be individually controlled by an electric control system, and that the harness threads would not interfere with each other. Further, it must be possible to selectively take out the actuators in question from the weaving mechanism for regular service, maintenance, or replacement operations. Lastly, the actuators must be positioned in a precise manner with respect to an electronic supply and control board.

The main objective of the present invention is to remedy these constraints by presenting a housing for the lodging of rotary electric actuators that would allow a precise positioning of the various actuators with a view to their interaction with the harness threads, a possibility of disassembly of one or of several of these actuators and their control by electric means.

SUMMARY OF THE INVENTION

With this in mind, the present invention relates to a housing for the positioning of electric actuators for the formation of the shed on a loom, comprising at least a compartment appropriate to house in a removable manner a last one actuator in such a position that a harness thread can be wound up on a pulley moved by said actuator.

Thanks to the present invention, the compartment or compartments constitute as many chambers for the rotary electric actuators, which facilitates a quick servicing of these actuators.

These compartments, whose geometry can be defined with precision, determine by interaction with the actuators the orientation of the latter.

In accordance with a first embodiment of the present invention, the compartments are arranged in rows and columns essentially perpendicular to the axis of rotation of the pulleys of the actuators. Thanks to this aspect of the invention, one housing can comprise an according number of compartments, while the pulleys of the actuators lodged in these compartments are arranged side by side which allows an easy access to the pulley assembly, particularly at the time of placing the harness threads.

In accordance with other embodiments of the invention, the compartment is appropriate for the retention of several actuators and comprises positioning means for the actuators inside the compartment. This allows to impart upon the housing great compactness but still obtaining the objectives of the invention. Several rows and columns of actuators can be provided inside the compartment. Depending on the variants of the embodiment, the means of positioning can be designed as ribs extending over a portion of the transversal dimensions of the compartment or as centering pieces.

In accordance with another advantageous aspect of the invention, the housing comprises a cover for enclosing the pulleys of the actuators. This cover facilitates the insulating of the pulleys and actuators against constant air-born fluff in the proximity of a textile machine in operation. This brings about an increased working life of these devices which, should they be exposed to the fluff, would tend to clog which would decrease their efficiency. The cover is provided with ribs to separate the actuators' pulleys. These separation ribs create an internal partitioning of the cover and facilitate the defining of the run of the harness threads that are being wound up on the pulleys with a view to ensure that no interference takes place between the harness threads or between the harness threads and the adjacent pulleys, including in the case of a harness thread breakage.

In this case and in accordance with another advantageous aspect of the present invention, it can be provided that when the compartments are arranged in rows or columns, some of the cover's ribs are oblique with respect to these columns or these rows; the oblique feature of the ribs make feasible the juxtapositioning of several harness threads, essentially parallel to each other. This type of design guarantees a minimum of interference between the harness threads and of friction on the stationary elements which limits their wear and tear.

In accordance with another advantageous aspect of the present invention, the housing comprises a guide bar provided with holes for the passing of the actuator-controlled harness threads. The function of this bar is to define the positioning of the harness threads with respect to the pulleys in order to ensure their best possible winding and unwinding, whichever their subsequent direction might be, in particular due to the position of the harness tie.

In accordance with another advantageous aspect of the present invention, each of the compartments is provided with a bottom deformation or rear wall with a hole for the power supply of the actuators housed in the compartments, which hole is on the opposite side of the pulleys secured to them. This facilitates the power supply of the actuators without any interference with the pulleys and the harness threads.

In accordance with another advantageous aspect of the present invention, this bottom deformation comprises a bearing surface for a bolting bracket firmly attached to the actuator in the corresponding housing. The interaction of the bearing surface and of the bolting bracket ensures a secure fastening of the actuator inside the compartment.

In accordance with another advantageous aspect of the present invention, the housing is provided with positioning means with respect to an electronic control device for the actuators positioned in the compartment, which electronic device comprises electric supply means and/or means for the detection of the angular position of the actuators. The housing can be connected to an electronic control device by a simple operation and, in particular, by clipping on. This ensures a satisfactory positioning of the actuators with respect to their pertinent control elements.

The invention also relates to a loom equipped with a weaving mechanism that comprises one or more housings such as described above. This loom is simpler to use and to maintain than the devices of known type, and it allows a thread by thread control of a Jacquard-type loom harness. Thus, its efficiency is considerably improved with respect to known techniques.

BRIEF DESCRIPTION OF THE DRAWINGS

The invention will be better understood and its other advantages will be shown more clearly through the below description of four embodiments of a housing for the lodging of rotary electric actuators in accordance with its principle, given only by way of example and making reference to the accompanying illustrations wherein:

FIG. 1 shows a view in perspective with a partial cutaway of a housing in accordance with the invention during creeling of bobbins with a rotary electric actuator;

DESCRIPTION OF THE PREFERRED EMBODIMENT

Figure 2:
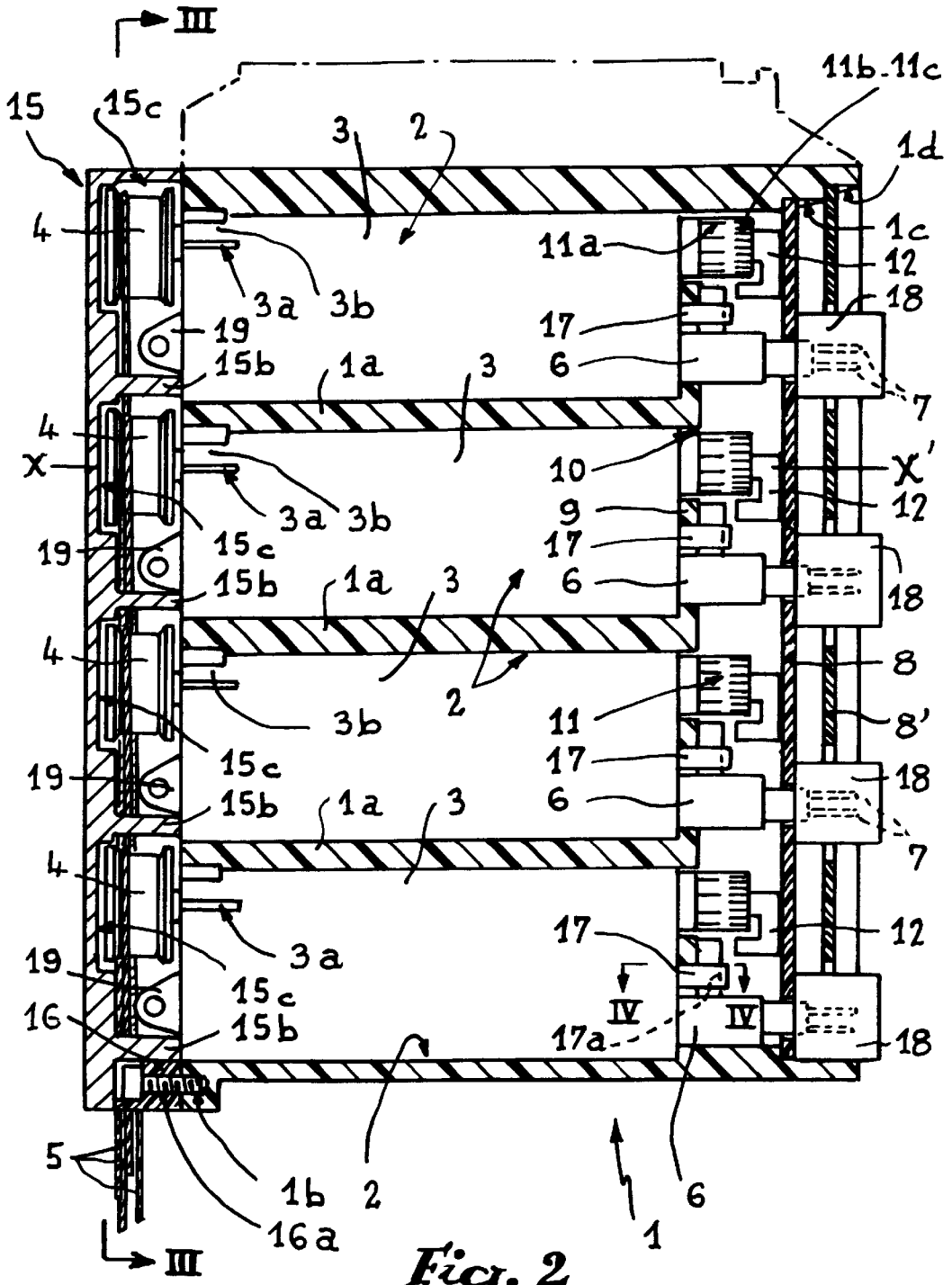
FIG. 2 shows a longitudinal section of the housing of FIG. 1, after the creeling of bobbins.

The housing 1 illustrated in FIG. 1 comprises sixteen compartments 2, arranged in four rows and four columns. The compartments 2 are separated by internal partitions 1*a* of the housing 1 that extent in two perpendicular directions, so that the compartments 2 present an essentially parallelepipedal section. Each compartment 2 presents an internal section essentially equal to the external section of a rotary electric actuator 3 which is to be housed in such compartment. Each actuator 3 is provided with a pulley 4 for the winding-up operation of a harness thread 5.

The actuator 3 may be positioned in the respective compartment 2 in a direction F essentially parallel to the axis of rotation XX' of the pulley 4. On its back, that is to say, opposite the pulley 4, the actuator 3 has an extension 6 provided with pins 7 for the electric connection to an electronic control device of a printed circuit board 8. Into a bottom of rear wall 9 of each compartment 2 is bored a hole 10 through which pass of the extension 6 and the pins 7.

As it can be seen more clearly in FIG. 2, the back edge of the housing 1 is provided with a first rabbet 1*c* for the housing and clamping of the board 8. Also provided is a second rabbet 1*d* for the housing of a second board 8'. Thus, the position of the boards 8 and 8' with respect to the housing 1 is defined with precision, so that the relative position of the actuators 3 with respect to the boards 8 and 8' is also precisely defined, which ensures a satisfactory functioning of the connector pins for the supply and the control of the actuators.

On its side opposite the pulley 4, the actuator 3 is also provided with a collar 11 rigidly affixed to the not represented rotor on which is mounted the pulley 4. The collar 11 is provided with notches 11*a* on its external radial surface. A clamping or braking force can be applied to the collar 11 essentially perpendicular to the axis of rotation XX' of the pulley 4. This force can be applied by any appropriate means while the notches 11*a* allow a blocking of the collar 1 in position. Further, teeth are cut into the collar 11 that delimit slots between them. The succession of these teeth and slots enable a scanner 12, be it of optical, infrared or the like type, to record the orientation of the collar 11 and of the pulley 4 around the axis XX'. The scanner is advantageously installed on the board 8.

As FIG. 2 illustrates it more clearly, when an actuator 3 is in place in the respective compartment, the pulley 4, lodged in such compartment, projects towards the outside of this compartment in order to allow the winding of the harness thread 5 it must control. Thus, each actuator controls the movement of a harness thread thanks to the pulley 4 provided on its front turned towards the left in FIG. 2, while it is controlled thanks to the pins 7 and the collar 11 positioned on its back turned towards the right in FIG. 2.

Figure 3:
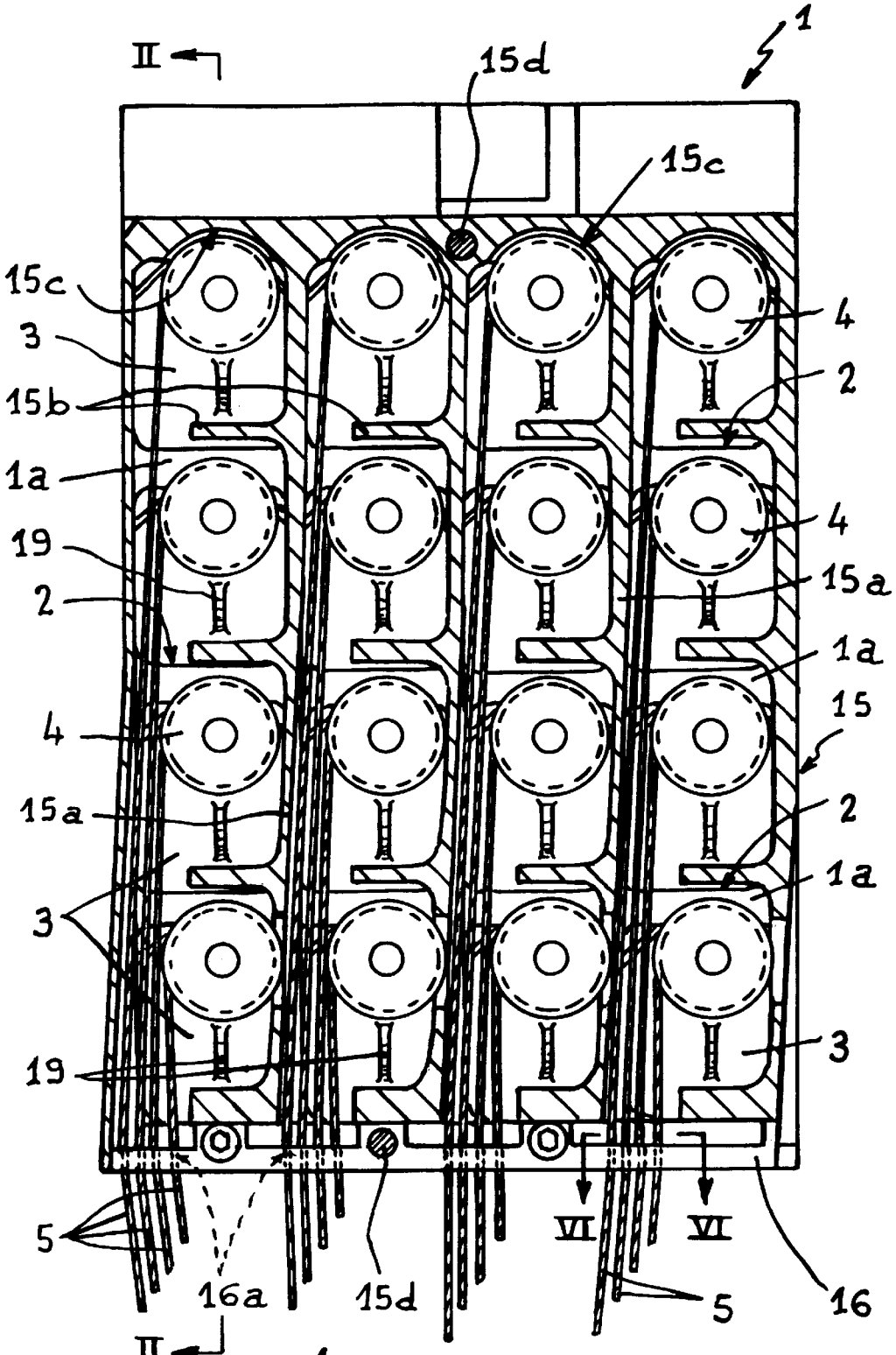
FIG. 3 shows a sectional drawing along the line III—III of FIG. 2, in which II—II indicates the line of the sectional drawing in FIG. 2.

In this position, a cover 15 is intended to enclose the sixteen pulleys of the actuators 3 that are arranged in the sixteen compartments 2 of the housing 1. This cover prevents the accumulation of fluff or the contact with an operator's tool while the pulleys are functioning. The cover 15 is provided with primary internal ribs 15*a* that extend in the direction of the separating partitions 1*a* of the housing 1. As particularly illustrated in FIGS. 1 and 3, the ribs 15*a* extend in a first direction essentially perpendicular to the axis XX' of the pulleys 4 in which they are contained, while they are also provided with secondary internal ribs 15*b*, arranged essentially perpendicular to the primary ribs 15*a*. The design of the ribs 15*a* and 15*b* enables the separation of the pulleys 4 from the various actuators, which prevents the circulation of fluff between the various pulleys. The ribs 15*b* do not meet with the ribs 15*a* because they are truncated in order to leave a passage for one or several harness threads 5 between their free end and the adjacent primary rib 15*a*. FIG. 3 clearly shows that the secondary ribs 15*b* are of different lengths, and that they become gradually shorter with an increased number of harness threads for which they leave a passage. The function of the ribs 15*b* is to prevent that a harness thread of a pulley of an upper actuator comes into contact with a pulley of a lower actuator, particularly in the case of a malfunctioning when an elastic return movement system pulls the harness threads downwards.

The ribs 15*a* are oblique in their lower area with respect to the columns formed by the compartments 2. The oblique feature of the ribs 15*a* has the purpose of allowing the passage of the harness threads 5 in a parallel manner in direction towards a guide bar 16 provided on the lower part of the housing 1. As a matter of fact, if the harness threads 5 were arranged essentially parallel to the line II—II in FIG. 2, a harness thread intended to wind around an upper pulley 4 would interfere with the pulley or pulleys installed below it as illustrated in FIG. 3. Thus, the oblique positioning of the harness threads 5 results in a reduction of the risks of interference between the harness threads and the pulleys.

This oblique positioning is obtained thanks to the guide bar 16 which is provided with holes 16*a* for the passing of the harness threads 5, controlled by the actuators 3. The positioning of the holes 16*a* on the bar 16 is chosen depending on the angle of inclination or of pitch of the ribs 15*a* in their lower area.

As illustrated in FIG. 2, taken as a whole, the holes 16*a* are on the plane of the first turn formed by the harness threads 5 being wound up on the pulleys 4 of a column of actuators. This on the harness threads 5 at the holes 16*a* and of the cord of the harness threads being wound on the cord of the harness threads already wound-up.

Figure 6:
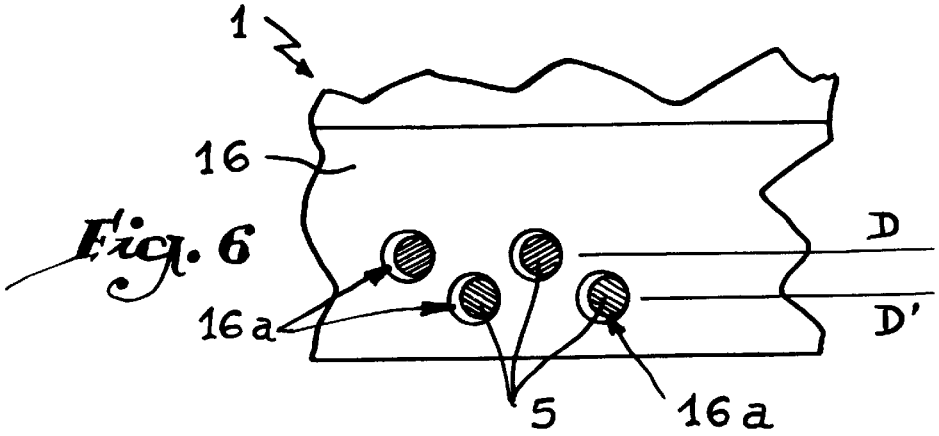
FIG. 6 shows an exploded drawing along the line VI—VI of FIG. 3.

As illustrated more clearly in FIG. 6, the holes 16*a* are arranged in zigzag, that is to say, alternately on two lines D and D' perpendicular to the axis of rotation XX' of the pulleys 4.

The cover 15 is also provided with the seats 15*c* for the front ends of the pulleys 4 in the position represented in FIG. 2. These seats define exactly the relative positioning of the various pulleys, so that the cover 15 cannot be mounted if one of the actuators 3 is not correctly installed in the pertinent compartment.

The cover is mounted on the housing 1 by means of screws represented by their lines of axes 15*d* and intended to enter into the threaded holes 1*b* of the housing 1.

In FIG. 1 can be noted that the actuator 3 is provided with two oblique slots 3*a* defining the movable wedges 3*b* with respect to the rest of the actuator 3 thanks to the elasticity of the material of which it is made. These movable wedges are pushed into the direction of the axis of rotation of the pulley 4 of each actuator when it is inserted into the pertinent compartment. They contribute to the blockage by friction of the actuator in its compartment.

Figure 4:
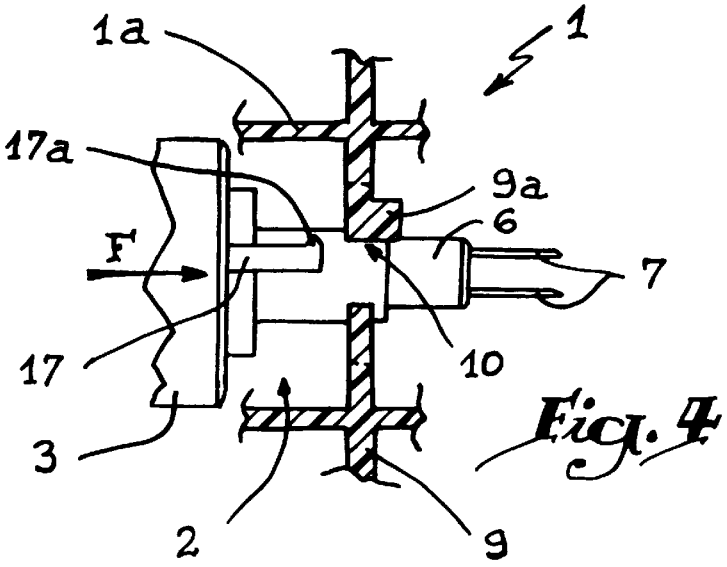
FIG. 4 is an exploded drawing along the line IV—IV of FIG. 2, at the time of the introduction of an actuator into a compartment.
Figure 5:
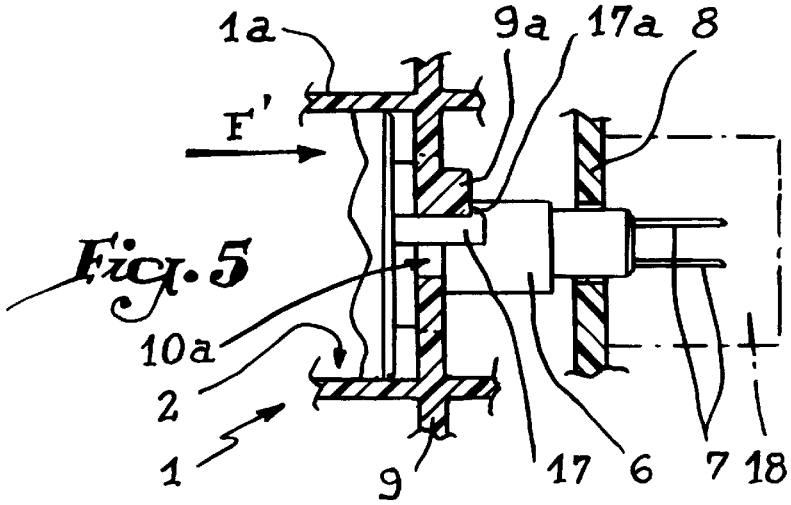
FIG. 5 shows a drawing analogous to that of FIG. 4 with the actuator bolted into position.

Each actuator 3 is provided with an elastic catch or hook 17, illustrated in FIGS. 4 and 5, the extremity of which is provided with a nose or tip 17*a* intended to become wedged on a bearing surface 9*a* of the rear wall 9. When the actuator 3 reaches the bottom, of the compartment 2 into which it is inserted according to the direction F, the elastic catch 17 is slightly deformed when its tip 17*a* passes through the hole 10. Then, and as illustrated in FIG. 5, the tip 17*a* rests against the surface 9*a* so that the actuator 3 is firmly held in its position.

When all the actuators 3 are in place in the pertinent compartments 2, the housing 1 can be pushed backwards toward the board 8 which is represented by the arrow F' in FIG. 5. The pins 7 enter then into a classic connecting device 18.

When it becomes necessary to service one or several actuators 3, it is possible to remove the entire unit of the housing 1, eventually firmly attached to the board 8, from the rest of the weaving mechanism. One can then proceed with the regular replacement of the housing.

According to another alternative, it is also possible to remove the cover 15 from the housing 1 and to take out one or several actuators 3, thanks to a pierced cramp 19 provided on the front of each actuator 3 in the proximity of pulley 4.

Depending on the number of threads to be controlled on the loom, it is possible that one housing 1 is not completely equipped. Should it become necessary, it can be easily completed at any time with additional actuators.

Figure 7:
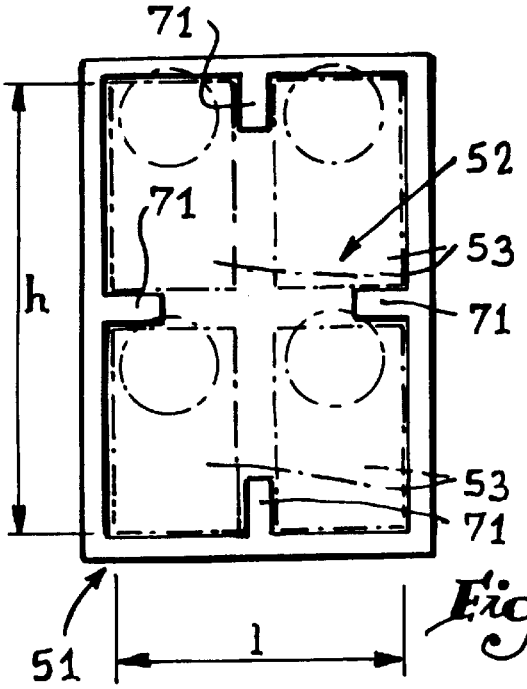
FIG. 7 shows a front view of a housing in accordance with a second embodiment of the invention.

In the second embodiment, illustrated in FIG. 7, the elements analogous to those of the embodiment of FIGS. 1 to 6 are identified by the same reference numbers but increased by 50. The housing 51 of this embodiment comprises one only compartment 52 appropriate to lodge four actuators 53, represented by dot-and-dash lines. The location of the actuators 53 in the compartment 52 are defined by ribs 71 that on the whole extend parallel to the sides of the housings 51 over one portion of the height (h) and the width (l) of the compartment 52. Thus, the ribs 71 facilitate a relative positioning of the actuators 53 inside of the compartment 52.

Figure 8:
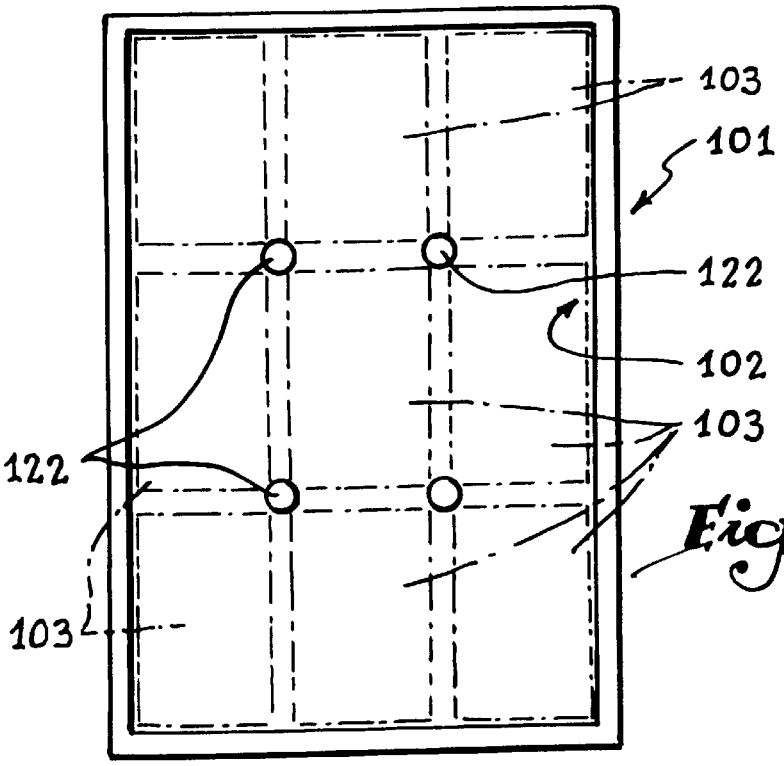
FIG. 8 shows a front view of a housing in accordance with a third embodiment of the invention.

In the third embodiment of the present invention, illustrated in FIG. 8, the elements analogous to these of the embodiment of FIGS. 1 to 6 are identified by the same reference numbers but increased by 100. In this embodiment, the housing 101 comprises only one compartment 102 which can accommodate nine actuators 103, represented by dot-and-dash lines. In the compartment 102 are provided centering pins 122 in order to define the positions of the actuators 103 in the compartment 102. The pins 122 are represented by a round section. However, they can present a cross-shaped section in order to present angles for the seating of the wedges of the actuators 103.

Figure 9:
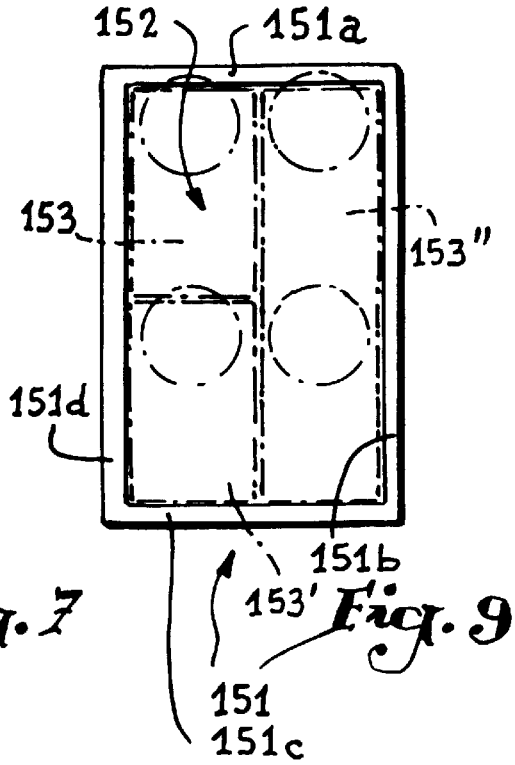
FIG. 9 shows a front view of a housing in accordance with a fourth embodiment of the invention.

In the fourth embodiment of the present invention, illustrated in FIG. 9, the elements analogous to those of the embodiment of the FIGS. 1 to 6, are identified by the same reference numbers but increased by 150. In this embodiment, the housing 151 comprises only one compartment 152 which can accommodate three actuators 153, 153' and 153", represented by dot-and-dash lines. The actuators 153 and 153' are simple, that is to say, they serve for the control of one only harness thread. On the other hand, the actuator 153" is double, that is to say, that it can control two harness threads, which is presented by dot-and-dash lines for the path of two pulleys. The relative positioning of the actuators 153, 153' and 153" inside the compartment 152 is obtained by the fact that the section of the compartment 152 corresponds precisely to the sum of the outside sections of the actuators 153, 153' and 153". In this case, the outside walls 151*a*, 151*b*, 151*c*, and 151*d* of the housing 151 are the only means of positioning for the actuators 153, 153' and 153" inside of the compartment 152.

Other variants of the present invention can also be contemplated, in which several simple or multiple actuators are lodged inside the same compartment. The compartments appropriate for the lodging of several actuators can be arranged in rows and columns, just like the compartments 2 of the first embodiment.

It is understood that the housings of the second, third and fourth embodiments can also be provided with a cover such as described for the first embodiment and, in general, with all the improvements of the first embodiment that are transposable.

Whichever the embodiment considered, the housing in accordance with the present invention facilitates a precise positioning of the actuators in the space, their tightness thanks to their cover, their cooling by energy dissipation, their electric connection to an electronic supply and control board, the support of their braking and safety device, the guiding of the harness threads, and its securing as well as the assembly on a support system such as, for example, a rail-shaped structural element.

In accordance with a not shown variant of the present invention, it would be possible to provide that the housing has a depth corresponding only to a portion of the length of the actuators 3, that is to say, of their dimension parallel to the axis XX', so that once installed in the housing, the actuators would project beyond the back of the housing. In such a case, a covering cap of parallelepipedal shape and without internal ribs can be installed on the back of the housing in order to cover the back parts of the actuators. This covering cap could be provided with means of electric connection. In this case, the positioning in the space of the actuators would be effectuated by the ribs or the pins of the housing that are between the actuators on their front.

The design can also be such, that it is also possible that the back of the housing is provided with skirts that extend parallel to the axis XX', with actuators in order to protect the electronic boards to which it is connected against the circulation of large amounts of fluff that is found in the operating environment of the actuators.

The housings of the invention were represented as lodging the rotary electric actuators. It must be understood that those housings allow the positioning of all types of electric actuators and, in particular, of linear actuators.

Whichever might be the considered embodiment, the housing is advantageously made out of a good thermal conductive material, particularly out of a metal such as aluminum or Zamak (registered trademark). This facilitates the cooling of the actuators that tend to heat up due to their electric power consumption.

Although essentially described as relating to an actuator for a Jacquard mechanism, the invention can also be applied to textile machines in general and, in particular, to machine-knitting for the control of the needles.

What we claim is:

1. An apparatus for winding and unwinding heddle cords of a shed forming device of a Jacquard type weaving loom, comprising:

a plurality of electrical actuators each having a rotary element which rotates about an axis of rotation, and a housing having front and rear portions and including a plurality of compartments which are adapted and configured to removably receive said electrical actuators when said actuators are moved, generally parallel to the direction of the axes of rotation of said rotary elements associated therewith.

2. The apparatus of claim 1 including means for locking said electrical actuators within said compartments as said actuators are moved longitudinally and parallel with respect to the rotational axes of said rotary elements into said compartments.

3. The apparatus of claim 1 in which each of said compartments includes a rear wall having an opening therein, each of said electrical actuators having an electrical connection extending from a rear portion thereof, said electrical connections extending through said openings in said rear walls upon the movement of said electrical actuators into said compartments, and means for electrically connecting each of said electrical connections to a source of electrical power supply.

4. The apparatus of claim 1 wherein each of said electrical actuators is adapted to be seated within said compartments so that said rotary elements extend outwardly thereof, and cover means removably secured to said housing for enclosing said rotary elements.

5. The apparatus of claim 4 in which said cover includes a plurality of separation ribs which extend between said rotary elements when said cover is mounted to said housing, and said ribs being spaced relative to one another to allow passage of the heddle cords from said housing.

6. The apparatus of claim 5 in which said cover includes a plurality of seats formed therein adapted to allow positioning of said rotary elements therein.

7. The apparatus of claim 4 wherein said housing includes a guidebar provided with openings therein which openings are adapted to receive harness cords passing to said rotary elements.

8. The apparatus of claim 1 in which each of said electrical actuators includes a locking catch extending therefrom, and said locking catches being engageable with a surface of said housing when said electrical actuators are positioned within said compartments.

9. The apparatus of claim 1, in which said compartments are oriented in rows and columns extending generally parallel relative to one another.

10. The apparatus of claim 9 in which said housing includes a cover which encloses said rotary elements of said electrical actuators.

11. The apparatus of claim 10 in which said cover includes a plurality of separation ribs extending between said rotary elements, and openings defined between said separation ribs adapted to allow passage of heddle cords therebetween.

12. The apparatus of claim 11 wherein each of said compartments includes a rear wall having an opening therein which is adapted to permit passage of at least a portion of said electric actuators.

13. The apparatus of claim 1 in which said plurality of compartments are defined by a plurality of spaced ribs.

14. The apparatus of claim 1 in which said plurality of compartments are defined by at least one centering pin.

15. In a weaving loom having a weaving mechanism including a shed forming device having a plurality of heddle cords associated therewith, the improvement comprising; a plurality of electrical actuators, each of said actuators having a rotary element rotatable about an axis of rotation and which rotary elements are adapted to wind and unwind one of the heddle cords, a housing, and said housing having a plurality of compartments for receiving said plurality of electrical actuators.

16. The weaving loom of claim 15 in which each of said electrical actuators includes a collar extending through an opening in a rear wall of said compartments, and detector means for monitoring said collars to monitor a rate of rotation of said rotary elements.

17. The weaving loom of claim 15 wherein each of said rotary elements is adapted to be seated within said compartments so that said rotary elements extend outwardly thereof, cover means being removably secured to said housing for enclosing said rotary elements, and said housing including means through which said harness cords pass to said rotary elements.

18. The weaving loom of claim 15 including means for locking said electrical actuators within said compartments as said actuators are moved longitudinally and parallel with respect to the rotational axes of said rotary elements into said compartments, each of said compartments including a rear wall having an opening therein, each of said electrical actuators having an electrical connection extending from a rear portion thereof, said electrical connections extending through said openings in said rear walls upon the movement of said electrical actuators into said compartments, and means for electrically connecting each of said electrical connections to a source of electrical power supply.

* * * * *